US008117960B2

(12) United States Patent
Hartl et al.

(10) Patent No.: US 8,117,960 B2
(45) Date of Patent: Feb. 21, 2012

(54) WATER-COOLED PISTON COMPRESSOR

(75) Inventors: Michael Hartl, Unterhaching (DE); Gerhard Pröll, Garching (DE); Dieter Weisse, München (DE)

(73) Assignees: Knorr-Bremse Systeme fur Nutzfahrzeuge GmbH, Munich (DE); Knorr-Bremse Systeme fur Schienenfahrzeuge GmbH, Munich (DE)

( * ) Notice: Subject to any disclaimer, the term of this patent is extended or adjusted under 35 U.S.C. 154(b) by 775 days.

(21) Appl. No.: 12/097,078

(22) PCT Filed: Dec. 13, 2006

(86) PCT No.: PCT/EP2006/011996

§ 371 (c)(1),
(2), (4) Date: Oct. 2, 2008

(87) PCT Pub. No.: WO2007/068463

PCT Pub. Date: Jun. 21, 2007

(65) Prior Publication Data

US 2009/0071324 A1 Mar. 19, 2009

(30) Foreign Application Priority Data

Dec. 13, 2005 (DE) ..... 10 2005 059 491

(51) Int. Cl.
*F04B 39/06* (2006.01)
*F25B 31/00* (2006.01)

(52) U.S. Cl. ..... 92/144

(58) Field of Classification Search ..... 92/144
See application file for complete search history.

(56) References Cited

U.S. PATENT DOCUMENTS

| | | | | |
|---|---|---|---|---|
| 2,510,887 | A | 6/1950 | Hanson | |
| 4,006,602 | A * | 2/1977 | Fanberg | 417/367 |
| 6,599,103 | B2 | 7/2003 | Finnemore et al. | |
| 6,609,899 | B1 | 8/2003 | Finnemore | |

FOREIGN PATENT DOCUMENTS

| | | | |
|---|---|---|---|
| DE | 10 20 840 | B | 12/1957 |
| DE | 10 47 367 | B | 12/1958 |
| DE | 2410705 | A * | 9/1975 |
| DE | 10308430 | | 9/2004 |
| EP | 0 538 471 | A1 | 4/1993 |
| EP | 0 976 993 | A | 2/2000 |
| GB | 293 605 | A | 7/1928 |
| GB | 832 177 | A | 4/1960 |

* cited by examiner

*Primary Examiner* — Thomas E Lazo
(74) *Attorney, Agent, or Firm* — Barnes & Thornburg LLP

(57) ABSTRACT

A water-cooled piston compressor having at least one air-compressing piston, which can be driven with means for producing a linearly oscillating drive force and which is accommodated in an axially movable manner in a cylinder housing which is closed at the end face via a cylinder head and is provided with water-cooling means, wherein the water-cooling means comprise a cylinder housing which is formed with a double wall and on whose end face facing the cylinder head a plurality of cooling openings are arranged, via which coolant flowing through the double-walled cylinder housing comes into contact with the region of the cylinder head.

6 Claims, 2 Drawing Sheets

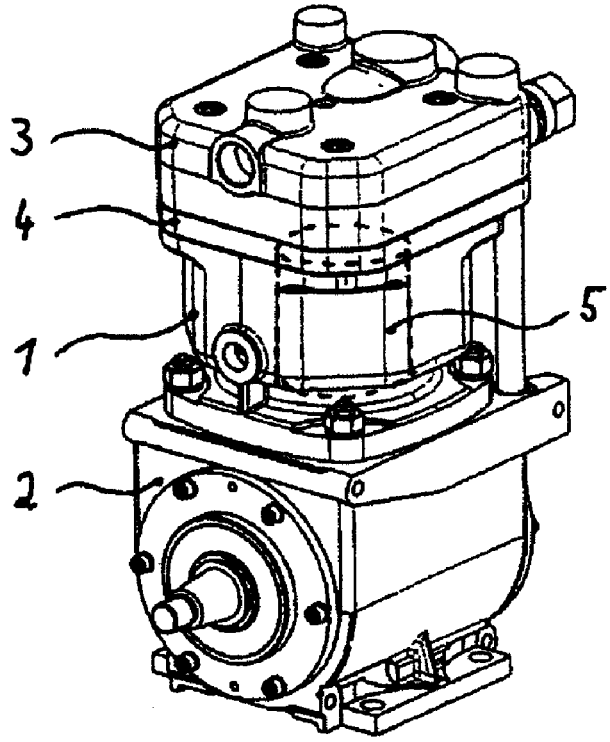
Fig.1
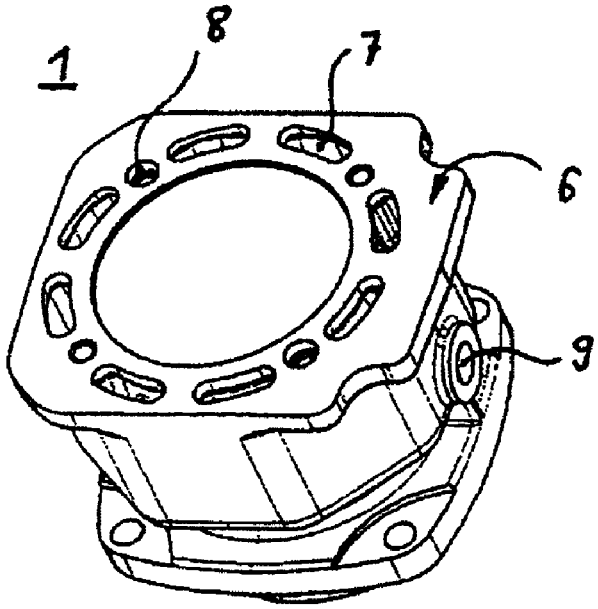
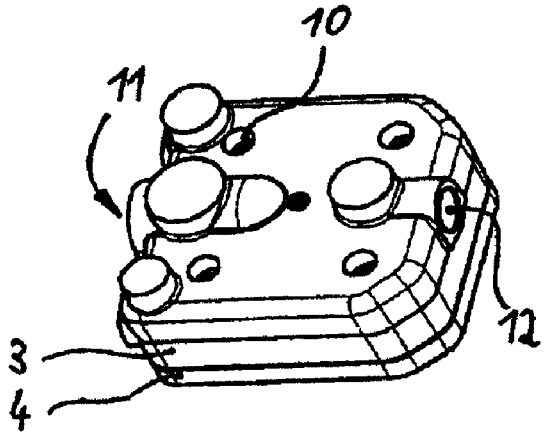
Fig.2
Fig.3

WATER-COOLED PISTON COMPRESSOR

CROSS-REFERENCE TO RELATED APPLICATIONS

This application is a National Phase Application based upon and claiming the benefit of priority to PCT/EP2006/011996, filed on Dec. 13, 2006, which is based upon and claiming the benefit of priority to German Application 10 2005 059 491.3, filed on Dec. 13, 2005, the contents of both of which are incorporated herein by reference.

BACKGROUND & SUMMARY

The present invention relates to a water-cooled piston compressor having at least one piston for compressing air, which can be driven by means for generating a linearly oscillating drive force and which is axially movably in a cylinder casing that is closed at the end side by a cylinder head and is provided with water-cooling means.

Piston compressors of the type of interest here are mainly used in automotive engineering. In particular in rail vehicles, piston compressors are used as equipment for generating compressed air. The compressed air generated in this way is used in rail vehicles to operate the brake system, for active suspension and the like. The compression of air within the piston-cylinder pairs in piston compressors also generates heat which has to be dissipated to the outside. Otherwise, a piston compressor would in long-term operation be heated to such an extent that its component parts, in particular seals, could be damaged. If structural boundary conditions make it impossible to use an air-cooled piston compressor, a water-cooled piston compressor that is of interest here is required. In a water-cooled piston compressor, the region of the piston-cylinder pairs is cooled by a coolant circuit that is known per se. Water-cooled piston compressors of the type that is of interest here can be driven by means of a crank mechanism, a swash-plate mechanism or the like.

DE 103 08 430 A1 has disclosed a water-cooled piston compressor with a swash-plate mechanism. Two piston-cylinder pairs are driven by the swash-plate drive mechanism. The swash-plate drive mechanism converts an input rotary movement into an oscillating linear movement for the pistons within the cylinders, so that by interaction with inlet and outlet valves air from the atmosphere can be compressed to form compressed air.

In this known piston compressor, a chamber through which the coolant flows is provided in the cylinder region for the purpose of water cooling. The chamber is formed by cylinder liners and a cylinder casing surrounding these cylinder liners. The cylinders liners are each of pot-shaped configuration, so that the coolant acts in the region of the lateral and end face of the cylinder. One drawback of this arrangement is that end-face cooling can only be achieved by corresponding deformation of the inner cylinder liners. Furthermore, seals are required both in the region of the end face and in the region of the lower lateral face, in order to seal the inner cylinder liners with respect to the cylinder casing surrounding them and the valve plate coming to bear against the end side of the cylinder liners. Any leak in one of these seals would lead to cooling water penetrating into the air region of the piston compressor.

Therefore, the object of the present disclosure is to provide a water-cooled piston compressor which, while being simple to manufacture, ensures efficient cooling of the cylinder region including cylinder head.

The piston compressor encompasses the technical teaching that the water-cooling means comprise a double-walled primary formed cylinder casing, at whose end face, facing the cylinder head, are arranged a plurality of cooling openings, via which the cooling water flowing through the double-walled cylinder casing comes into contact with the region of the cylinder head.

The advantage of the solution is that the cooling openings on the end face side can be produced without major manufacturing outlay, since they can be provided at a suitable location during casting of the double-walled cylinder casing. This is because the sand cores which form the double wall are removed via the cooling openings. These openings, which are present on account of the casting technology used, are now, according to the disclosure, arranged at locations where they can be used for cooling purposes after the cylinder casing has been produced. This merely requires the openings, which are present on account of the casting technology, used to be positioned in such a manner, in terms of their size or distance from one another, at the end face of the cylinder casing that the desired cooling effect is established during further use.

The region of the cylinder head includes a valve plate which comes to bear against the end face of the cylinder and on which the cylinder head in turn is arranged. Therefore, the valve plate is located in sandwich style between the cylinder casing and the cylinder head. In this arrangement, the valve plate comes into direct contact with the coolant. Since the valve plate, on account of the inlet and outlet valves incorporated therein, constitutes a component that is subject to high thermal stresses, the solution according to the disclosure allows direct cooling via the adjoining cooling openings of the cylinder casing.

According to another, the valve plate has at least one inlet, corresponding to one of the cooling openings of the cylinder casing, for transferring the cooling water into the region of the cylinder head. This then provides the possibility of using coolant, via the inlet and coolant passages in communication with the inlet in the valve plate, for locally close cooling of the inlet and outlet valve region of the valve plate. Furthermore, the valve plate may have a further outlet for transferring cooling water into the cylinder head. In this case, the cylinder head arranged adjacent to the valve plate may have coolant passages passing through it for the purpose of guiding the cooling water. It is particularly advantageous for the coolant passages to be led around the region of the compressed-air outlet of the piston compressor, in order for the compressed air, which has been heated as a result of the compression operation, to be directly cooled before it leaves the cylinder head.

Furthermore, it is proposed that at least one coolant port, as an inlet for the coolant, be arranged on the outside of the cylinder casing. The coolant port required as an outlet for the heated coolant may be arranged either likewise in the cylinder casing or on the cylinder head. The latter arrangement is recommended if coolant, in addition to cooling the cylinder casing, is also responsible for cooling the valve plate and/or cylinder head. According to a further measure, which maximizes the efficiency of cooling, it is proposed that the coolant, starting from the coolant port that forms the inlet, flow around the cylinder casing on both sides in order to effect a uniform cooling action. In addition, it is also possible for the coolant to flow around the cylinder casing from just one direction. Corresponding passages and barrier walls can be produced by casting in the double-walled cylinder casing. It is thus also possible, for example, for the coolant stream to flow in a meandering configuration in the cylinder casing, as seen in the axial extent of the cylinder casing.

In a embodiment, the cylinder casing has more than four cooling openings which are substantially in the shape of segments of a ring At least four threaded bores, arranged symmetrically with respect to one another, are arranged there between for securing the cylinder head. This ensures both uniform securing of the cylinder head at the end side of the cylinder casing and also maximizes the cooling area generated as a result of the cooling openings.

Further measures that improve the compressor are presented in more detail below together with the description of a preferred exemplary embodiment of the invention with reference to the figures:

BRIEF DESCRIPTION OF THE DRAWINGS

FIG. 1 shows a perspective outer view of a single-cylinder water-cooled piston compressor, FIG. 2 shows a perspective outer view of the cylinder casing of the piston compressor shown in FIG. 1, FIG. 3 shows a perspective outer view of the cylinder head with valve plate of the piston compressor shown in FIG. 1.

DETAILED DESCRIPTION OF THE EMBODIMENT

Figure 4:
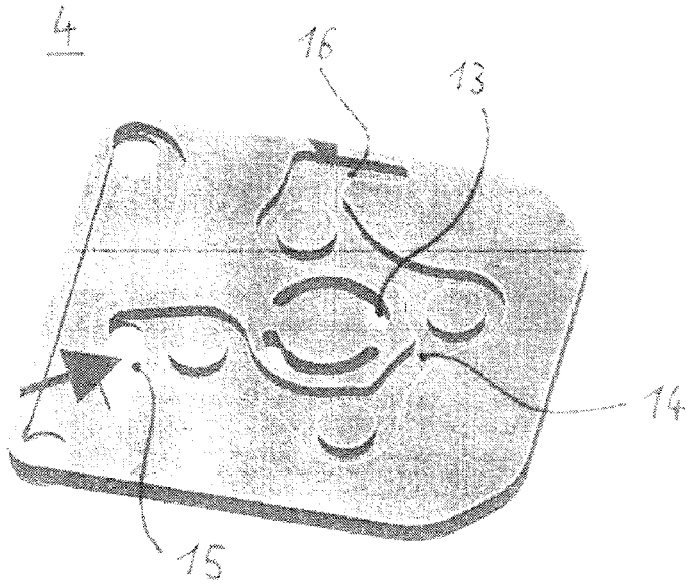
FIG. 4 shows a perspective sectional illustration of the valve plate.

In accordance with FIG. 1, a water-cooled piston compressor substantially comprises a cylinder casing 1 which is screwed onto a crankcase 2 containing a crank mechanism. A cylinder head 3 is arranged on the opposite side of the cylinder casing 1 from the crankcase 2. The cylinder head 3 comprises a valve plate 4 which is positioned sandwich-style between the cylinder casing 1 and the cylinder head 3. A piston 5, which is indicated here by dashed lines, for compressing air is located within the cylinder casing 1.

In accordance with FIG. 2, the cylinder casing 1 is a double-walled primary formed component, here consisting of aluminum alloy for example. At the end face 6 facing the cylinder head 3 (not shown in more detail here) the cylinder casing 1 has a plurality of cooling openings 7. The cooling openings 7 are configured in the shape of segments of a ring. The coolant flowing through the double-walled cylinder casing 1 comes into contact with the region of the cylinder head 3 via the cooling openings 7. Furthermore, a plurality of threaded bores 8, which are arranged symmetrically with respect to one another, are arranged on the end face 6 of the cylinder casing 1 for securing the cylinder head 3 to the cylinder casing. The coolant passes into the cavity of the double-walled cylinder casing 1 through a coolant port 9 which is formed as an inlet.

In accordance with FIG. 3, the cylinder head 3 illustrated here, with valve plate 4, has a plurality of through-bores 10 which serve to receive screws (not shown in more detail) that can be screwed into the above-mentioned threaded bores 8. Furthermore, on the cylinder head 3 there is an air inlet 11, through which the air that has been sucked in from the atmosphere and pre-filtered passes into the piston compressor. The compressed air generated by the piston compressor leaves the compressor again via a compressed-air outlet 12.

In accordance with FIG. 4, the compressed-air flow of the piston compressor is generated by inlet valves and outlet valves, which are not shown in more detail here but are known per se. The inlet and outlet valves are arranged in an inlet and outlet valve region 13 of the valve plate 4. Coolant passages 14 extend around this inlet and outlet region 13 of the valve plate 4. On the entry side, the coolant passages 14 are in communication with an inlet 15 of the valve plate 4. The inlet 15 of the valve plate 4 corresponds to one of the above-described cooling openings 7 of the cylinder casing 1. Furthermore, the valve plate 4 also has an outlet 16, via which the coolant is transferred into the cylinder head 3.

Figure 5:
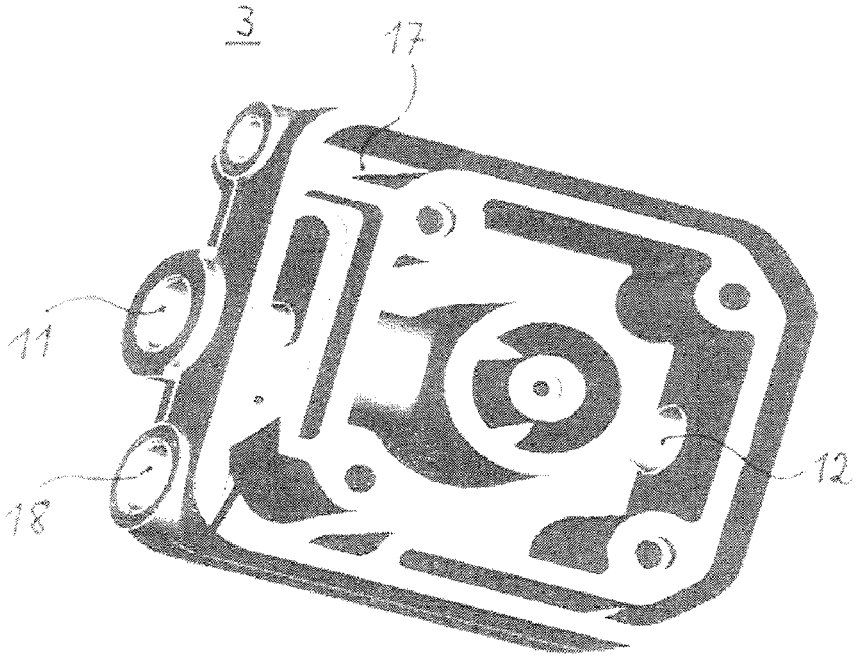
FIG. 5 shows a perspective inner view of the cylinder head.

In accordance with FIG. 5, the coolant which has been transferred in this way, within the cylinder head 3, enters coolant passages 17 likewise formed therein. The coolant passages 17 of the cylinder head 3 are arranged around the region of the compressed-air outlet 12, in order for the compressed air heated as a result of the compression operation to be cooled before it leaves the cylinder head 3. Furthermore, there is a further coolant port 18, which in the present exemplary embodiment serves as an outlet for the coolant, in the cylinder head 3.

The present disclosure is not restricted to the exemplary embodiment described above. Rather, modifications are also conceivable and encompassed by the scope of protection of the claims below. For example, the water-cooled piston compressor may also be formed as a multi-cylinder piston compressor. Furthermore, it is also conceivable for the flow of coolant to be restricted to the double-walled cylinder casing 11 alone. In this case, a further coolant port, as outlet for used coolant, would have to be arranged on the cylinder casing.

Furthermore, it should be noted that the solution according to the disclosure is particularly suitable for oil-free piston compressors, since the problem of sufficient cooling in the region of the cylinder is particularly acute here.

The invention claimed is:

1. A water-cooled piston compressor comprising:

at least one piston configured to axially compress air that is movably accommodated in a cylinder casing that is closed at an end side by a cylinder head, the cylinder head including a valve plate engaging an end face of the cylinder casing, the cylinder casing being double-walled, the end face including a plurality of cooling openings via which coolant flowing through the double-walled cylinder casing comes into contact with the valve plate, the valve plate having single inlet corresponding to one of the cooling openings of the cylinder casing for transferring the cooling water into the region of the cylinder head, at least one coolant port configured as an inlet for the coolant and being arranged on the outside of the cylinder casing, and a further coolant port configured as an outlet for the coolant and being arranged on one of the cylinder head and the cylinder casing such that the coolant, starting from the coolant port that forms the inlet, flows around the cylinder casing on both sides to effect a uniform cooling action, wherein the cylinder casing includes more than four cooling openings that are substantially in the shape of segments of a ring.

2. The water-cooled piston compressor of claim 1, wherein the valve plate includes coolant passages, which are in communication with the inlet, so as to cool an inlet and outlet valve region.

3. The water-cooled piston compressor of claim 1, wherein the valve plate has at least one outlet for transferring cooling water into the cylinder head.

4. The water-cooled piston compressor of claim 3, including coolant passages which pass through the cylinder head for guiding the cooling water through the cylinder head.

5. The water-cooled piston compressor of claim 4, wherein the coolant passages are arranged around the region of the compressed-air outlet for cooling the compressed air which has been heated as a result of the compression operation before the coolant leaves the cylinder head.

6. The water-cooled piston compressor of claim 1, further comprising at least four threaded bores arranged symmetrically with respect to one another between the cooling openings for securing the cylinder head to the cylinder casing.

* * * * *